US005454132A

United States Patent [19]

Neves

[11] Patent Number: 5,454,132

[45] Date of Patent: Oct. 3, 1995

[54] DEVICE FOR REMOVING SNOW, WATER, AND/OR ICE FROM SKI GOGGLES

[76] Inventor: Frank D. Neves, 60 Howard St., Agawam, Mass. 01101

[21] Appl. No.: 117,606

[22] Filed: Sep. 7, 1993

[51] Int. Cl.[6] ..... A47L 25/00

[52] U.S. Cl. ..... 15/105; 15/236.05; 15/236.08; 15/245

[58] Field of Search ..... 15/105, 117, 121, 15/236.01, 236.02, 236.05, 236.08, 236.09, 245, 245.1

[56] References Cited

U.S. PATENT DOCUMENTS

| | | | |
|---|---|---|---|
| D. 30,404 | 3/1899 | Booker | 15/245 |
| 691,801 | 1/1902 | Palmer | 15/245 |
| 896,394 | 8/1908 | Kindred | 15/105 |
| 1,586,439 | 5/1926 | Bennington | 15/245 |
| 1,628,243 | 5/1927 | Hagen | 15/245 |
| 1,681,082 | 8/1928 | Bamberger | 15/245 |
| 1,779,293 | 10/1930 | Rodgers | 15/236.05 |
| 2,019,975 | 11/1935 | Hoyer | 15/236.05 |
| 2,046,334 | 7/1936 | Loeber | 15/236.05 |
| 2,046,599 | 7/1936 | Andrews | 15/245 |
| 2,048,792 | 7/1936 | Hendey | 15/245 |
| 2,446,401 | 8/1948 | Ziskind | 15/121 |
| 2,860,858 | 11/1958 | Kurs | 15/236.09 |
| 3,274,684 | 9/1966 | Marks | 15/236.05 |
| 3,878,581 | 4/1975 | Perna | 15/245 |
| 3,995,345 | 12/1976 | Larsson | 15/117 |
| 4,236,270 | 12/1980 | Mavis | 15/245 |
| 4,281,433 | 8/1981 | Sendoykas | 15/105 |
| 4,342,128 | 8/1982 | Doyle | 15/245 |
| 4,380,840 | 4/1983 | Rieckenberg | 15/236.05 |
| 4,409,700 | 10/1983 | Sullivan | 15/245 |
| 4,982,471 | 1/1991 | Bannan | 15/236.05 |

FOREIGN PATENT DOCUMENTS

| | | | |
|---|---|---|---|
| 130275 | 11/1948 | Australia | 15/245 |
| 3420639 | 12/1985 | Germany | 15/105 |

*Primary Examiner*—Timothy F. Simone
*Assistant Examiner*—Mark Spisich

[57] ABSTRACT

Disclosed is a device for use by a skier to remove snow, ice and/or water from the glass inside and outside surfaces of a ski goggle and from the vent holes of the ski goggle. The device generally comprises a hand gripping portion having a longitudinal axis, a head portion connected to said hand gripping portion, and a wiper blade connected to head portion. The wiper blade has a contact surface adapted to engage with the inner and outer surface of the ski goggle and is configured so that the contact surface is offset from the longitudinal axis of the hand gripping portion so that a person may easily grasp the hand gripping portion with a substantially full grip and engage the contact surface with the inner and outer surface of the ski goggle. The device further comprises a vent hole scraper adapted so that the skier may remove snow and/or ice from the vent holes of the ski goggle.

7 Claims, 1 Drawing Sheet

DEVICE FOR REMOVING SNOW, WATER, AND/OR ICE FROM SKI GOGGLES

FIELD OF THE INVENTION

The present invention generally relates to devices for removing snow, ice, and/or water, and more particularly to devices for removing snow, ice, and/or water from ski goggles.

BACKGROUND OF THE INVENTION

Ski goggles or glasses are frequently used by a skier to enhance or assist their vision while skiing. Ski goggles normally include a plurality of vent holes which are adapted to vent the inside glass surface of the ski goggles so that water will not condense on the inside surface which would inhibit the skier's vision. However, during snowy or other less desirable conditions, the outside glass surface and vent holes of the ski goggle frequently become covered with snow, ice, and/or water which thereby renders the ski goggles ineffective.

To clean the ski goggles, skiers commonly remove their ski goggles and their gloves and then wipe the inside and outside glass surfaces of the ski goggle with a paper towel or other type of water absorbent material. This cleaning procedure has a number of obvious drawbacks, not the least of which is the necessity of carrying a paper towel which thereafter remains wet and becomes frozen thereby rendering the towel useless for subsequent applications. Furthermore, the skiers must remove their gloves to obtain and apply the towel to the ski goggle thereby exposing their hands to the cold and wet environment. Still further, the water absorbent material is not suited for cleaning the vent holes. As such, when the ski goggle is subsequently worn by the skier, water and/or mist quickly condenses on the inside glass surface of the ski goggle thereby requiring the skier to stop and once again clean the ski goggle.

In an attempt to overcome some of the above disadvantages, devices have been developed to remove snow and/or water from ski goggles. One such conventional device is shown in U.S. Pat. No. 4,342,128. This patent discloses a device 10 having a small handle portion 11 and a wiper 21 attached to an end thereof. The small handle portion 11 has a notch 19 which allows a skier to grasp the device using her thumb and index finger. A retainer cord 23 is provided so that the device 10 may be worn around the neck of a skier. Devices exemplified by U.S. Pat. No. 4,342,128 have several drawbacks which make their use difficult and ineffective. In particular, the wiper is perpendicular to the handle portion thereby making it difficult for the skier to apply the wiper to inside surface of the ski goggle. Still further, skiers can only grasp the device using their thumb and index fingers and because ski gloves are normally quite bulky, skiers must still remove their gloves in order to grasp their device, thereby exposing their hands to the outside environment. Further, such devices are not suited for cleaning the vent holes of the ski goggles and as such, subsequent uses of the ski goggle result in water quickly condensing on the inside surface of the ski goggle.

SUMMARY OF THE PRESENT INVENTION

One object of the present invention was to develop a device which could be used by a skier to quickly remove snow, ice, and/or water from both the inside and outside surface of a ski goggle.

Another object of the present invention was to develop a device which could be used by a skier to remove snow, ice and/or water from a ski goggle without removing their ski gloves.

Another object of the invention was to develop a multipurpose device which could be used by a skier to remove snow, ice and/or water from the glass surface of a ski goggle as well as removing snow and/or ice from the vent holes of a ski goggle.

Another object of the invention was to develop a multipurpose device which could be used by a skier to remove snow, ice and/or water from the glass surface of a ski goggle as well as other equipment used by the skier such as ski bindings and boots.

Another object of the invention was to develop a multipurpose device which could be used by a skier to remove snow, ice and/or water from the glass surface of a ski goggle as well as assist in the opening of a ski boot buckle.

The above objects are realized through the present invention which in one embodiment generally comprises a hand gripping portion, a head portion connected to the hand gripping portion, and a wiper blade connected to head portion. The wiper blade has a contact surface adapted to engage with the inner and outer surface of a ski goggle. The contact surface is angled or offset from the hand gripping portion so that a person may easily grasp the hand gripping portion with their ski gloves on and engage said contact surface with the inner and outer surface of the ski goggle. The device also comprises a neck tie or band which allows the device to be worn around the neck of a skier.

The device may further comprise a vent hole scraper portion adapted to clean the vent hole portion of a ski goggle.

The device may further comprise a boot latch opener portion adapted to assist a skier in the opening of a ski boot buckle.

The device may further comprise a large area scraper portion which may be used by the skier for a variety of snow and/or ice removal application such as removing snow and/or ice from ski bindings and boots.

BRIEF DESCRIPTION OF THE DRAWINGS

The following detailed description of the present invention will be better understood with reference to the accompanying drawings in which.

DETAILED DESCRIPTION OF THE INVENTION

Figure 3:
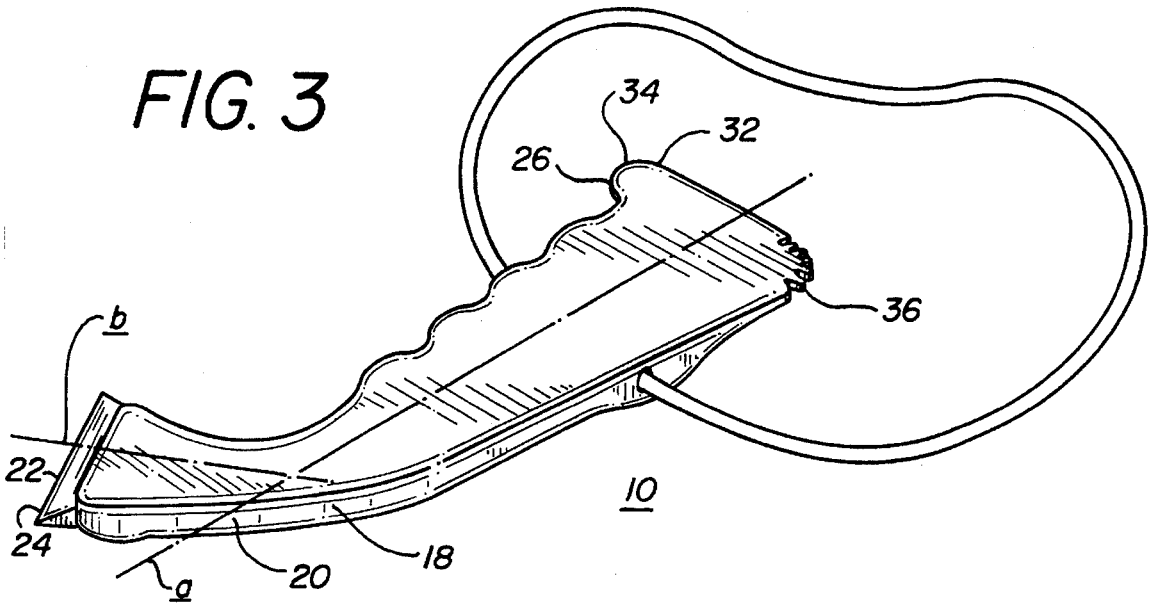
FIG. 3 is a perspective view of the first embodiment of the present invention.
Figure 1:
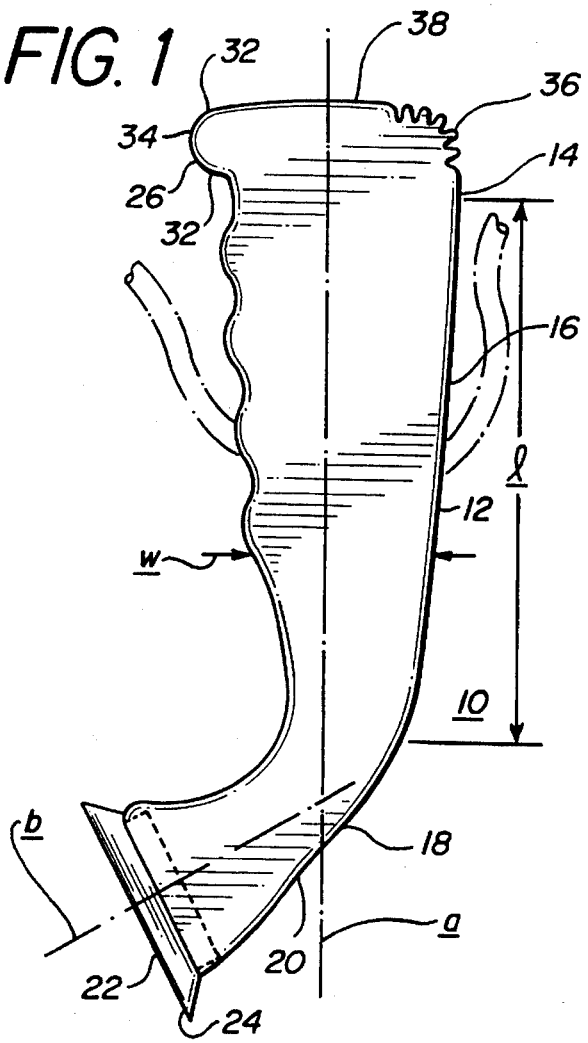
FIG. 1 is perspective view of a first embodiment of the present invention.
Figure 2:
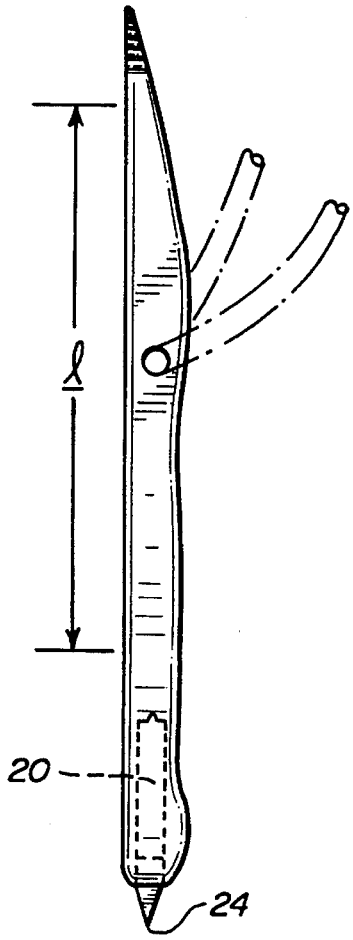
FIG. 2 is a side view of the first embodiment of the present invention.

Referring to FIG. 1 where a first embodiment of the device 10 of present invention is shown generally comprising a body portion 12 having an end portion 14, a hand gripping portion 16, a neck portion 18, and a head portion 20. The hand gripping portion 16 is configured to have a width w and a length 1 adapted so that a skier can easily grasp the device without removing their ski gloves. In the preferred embodiment, the width w of hand gripping portion 16 is about 1.25 inches at the point where it adjoins end portion 14 and tapers downward to about 1.0 inches where the hand gripping portion 16 adjoins the neck portion 18. Although not shown, the hand gripping portion 16 may be configured with finger shaped grooves or otherwise contoured so that it will comfortably fit within the hand of a skier. Hand gripping portion 16 is generally centered about an axis a while the neck portion 18 and head portion 20 are centered about an axis b which is offset from axis a.

The device 10 further comprises a wiper 22 connected to head portion 20. The wiper 22 is disposed with a cavity or groove formed in head 20 and is formed with a tapered contact surface 24 adapted to remove snow, ice and/or water from the inside and outside glass surfaces of the ski goggle. The contact surface 24 which is perpendicular to axis b is offset about 45 degree from axis a defining the orientation of the hand gripping portion 16. The angular relationship of the contact surface 24 of the wiper 22 to the hand gripping portion 16 allows a skier to easily grasp the device 10 and clean the inside surfaces of the ski goggle.

The device further comprises an elastic neck cord 26 mounted through an opening 28 provided in the hand gripping portion 16. The neck cord 26 is adapted so that a skier may wear the device 10 around their neck while skiing.

The device 10 may further comprise a vent hole scraper portion 30 extending from a side of end portion 14. Vent hole scraper portion 30 is adapted so that a skier may remove snow and/or ice from the vent holes of a ski goggle allowing venting of the inside glass surface of the ski goggle. The vent scraper portion 30 is formed with a tapered end 32 having rounded corners 34 to facilitate the use of the vent hole scraper 30.

The device 10 may further comprise a boot latch opener portion 36 formed on one end of portion 16 and which may be used by a skier to assist in opening a ski boot buckle. Although not shown, the boot latch opener portion 36 may be flipped or contoured upward or downward so as to provide leverage and/or a fulcrum point to assist in the opening of the ski boot buckle.

The device 10 may further comprise a large scraper portion 38 which may be used by the skier for a variety of snow and/or ice removal applications such as the removal of snow and/or ice from ski bindings or boots. In the preferred embodiment, the large scraper portion 38 comprises a plurality of notches 40 which facilitate the removal and/or scraping of snow and/or ice from normally hard to reach and/or inaccessible areas.

The foregoing description has been for illustrative purposes only. As will be obvious to one skilled in the art, the present invention may be readily modified without departing from the spirit and scope of the invention as defined by the following claims.

What is claimed:

1. A device for use by a skier wearing ski gloves on their hands and a ski goggle having inner and outer transparent surfaces and vent holes, the device being adapted for removing snow and/or water from the inner and outer surfaces of the ski goggle and the vent holes, the device comprises:

an elongated hand gripping portion defining a longitudinal axis and having first and second ends, a length substantially parallel to said longitudinal axis, and a width substantially perpendicular to said longitudinal axis;

an elongated head portion connected to said first end of said elongated hand gripping portion; such that said head portion and said elongated hand gripping portion define an obtuse angle therebetween; and an elongated wiper blade connected to said head portion, said wiper blade having an elongated contact surface adapted to engage with the inner and outer surface of the ski goggle, said wiper blade being laterally spaced from said longitudinal axis of said elongated hand gripping portion said elongated wiper blade being substantially co-planar with said elongated hand gripping portion, said contact surface and the longitudinal axis of said hand gripping portion defining an acute angle therebetween so that a skier may grasp said elongated hand gripping portion to engage said contact surface with the inner and outer surface of the ski goggle.

2. The device of claim 1 further wherein said acute angle is about 45 degrees.

3. The device of claim 1, wherein said width and said length of said elongated hand gripping portion are large enough so that a skier may grasp said elongated hand gripping portion with their ski gloves on.

4. The device of claim 3, further comprising a vent hole scraper portion disposed on said second end of said elongated hand gripping portion and adapted so that the skier may remove snow and/or ice from the vent holes of the ski goggle.

5. The device of claim 3, further comprising a boot latch opener disposed on said second end of said elongated hand gripping portion and adapted so that the skier may open a ski boot buckle.

6. The device of claim 3, further comprising a larger scraper portion disposed on said second end of said elongated hand gripping portion and adapted for general purpose snow and ice removal applications.

7. The device of claim 6, wherein said large scraper portion comprises a plurality of notches.

* * * * *